United States Patent [19]

Lazazzero

[11] 4,302,046

[45] Nov. 24, 1981

[54] PURSE HOLDER

[76] Inventor: Esther Lazazzero, 86 Greenlawn Ave., Clifton, N.J. 07013

[21] Appl. No.: 963,482

[22] Filed: Nov. 24, 1978

Related U.S. Application Data

[63] Continuation-in-part of Ser. No. 685,727, May 12, 1976, abandoned.

[51] Int. Cl.[3] ..... A47C 7/62

[52] U.S. Cl. ..... 297/191; 224/275; 297/219; 297/229

[58] Field of Search ..... 150/34; 224/275; 297/188, 191, 219, 229, 231

[56] References Cited

U.S. PATENT DOCUMENTS

| | | | |
|---|---|---|---|
| 1,279,915 | 9/1918 | Rogers | 150/34 |
| 2,223,532 | 12/1940 | Sallop | 297/191 X |
| 2,703,426 | 3/1955 | Barkl | 297/191 X |
| 3,014,759 | 12/1961 | Bing | 297/191 |
| 3,151,909 | 10/1964 | Gerdetz | 297/188 |
| 3,479,085 | 11/1969 | Weinstein | 297/219 |

FOREIGN PATENT DOCUMENTS

| | | | |
|---|---|---|---|
| 174850 | 2/1922 | United Kingdom | 297/119 |
| 1476493 | 6/1977 | United Kingdom | 297/191 |

*Primary Examiner*—William E. Lyddane
*Attorney, Agent, or Firm*—Robert D. Farkas

[57] ABSTRACT

This disclosure pertains to a slip cover device adapted to be positioned over the uppermost portions of a chair backrest. The open mouth portion of an inverted U shaped cross-section fabricated from a flexible material is applied downwardly surrounding the uppermost marginal edges of the backrest of the chair. The rearmost surface of the cover is provided with a pouch having an open mouth at the uppermost region thereof. A purse may be stored in the pouch, utilizing a flexible strip hingeably affixed at one end and removably affixed at the other end to the rearmost surface of the cover to capture the handle of the purse. One marginal edge of the inverted U shaped cross-section, that is applied downwardly surrounding the uppermost marginal edges of the backrest of the chair, is elongated, such that the elongated portion may be attached to selected areas of the chair itself or the pouch portions of the apparatus or the portion of the apparatus which resides on the top of the backrest of the chair.

10 Claims, 4 Drawing Figures

PURSE HOLDER

This application is a continuation-in-part of prior U.S. Application Ser. No. 685,727, filed May 12, 1976 now abandoned.

BACKGROUND OF THE INVENTION

1. The Field of the Invention

This invention relates to slip covers for furniture and more particularly to that class providing a pouch and article securing means affixed thereto.

2. Description of the Prior Art

The prior art abounds with a plurality of slip covers having article carriers affixed thereto. U.S. Pat. No. 3,479,085 issued on Nov. 18, 1969 to E. Weinstein teaches a slip cover having a plurality of article carrying pouches and receiving areas affixed to a slip cover whose principle function is to cover the backrest panel of the front seat of a motor vehicle. U.S. Pat. No. 2,223,532 issued on Dec. 3, 1940 to H. A. Sallop discloses a backrest seat cover for the front seat of a motor vehicle having a pouch affixed thereto whose outermost panel is openable, utilizing a slide fastener therefor. An inner surface of the pouch is provided with a plurality of article storing compartments, each having a separate open mouth. U.S. Pat. No. 3,014,759 issued on Dec. 26, 1961 to H. A. Bing teaches a pouch fitted to a supporting flexible sheet. The bottom of the pouch and distantmost end of the sheet parallel thereto are each fitted with a plurality of adjustable straps extending outwardly therefrom. The free end of each strap is fastened to a book-like member which is utilized to secure the pouch and supporting sheet to the internal spring components of the front seat of an automobile.

Each of the aforementioned patents failed to disclose means to selectively secure a purse within the pouch.

SUMMARY OF THE INVENTION

A primary object of the present invention is to provide a purse storage device which may be conveniently employed on the backrest portion of a chair.

Another object of the present invention is to provide a purse storing pouch whose storage capacity is bounded only by the width of a chair.

Still another object of the present invention is to provide a purse handle grasping strap which minimizes theft of the purse when stored within the pouch.

Yet another object of the present invention is to provide a purse storing slip cover which may be retained over the backrest of the chair by the application of binding forces applied by the back of the purse owner to the back supporting portion of the chair.

A further object of the present invention is to provide the outermost surface of the pouch with transparent material, thereby minimizing the possibility of theft and accidental overlooking of the purse stored there behind.

A still further object of the present invention is to provide an inexpensive purse storage device which may be stored within the purse when not in use.

Yet another object of the present invention is to provide a purse storage device which may be secured to the chair, preventing the accidental or purposeful dislodgement of the device from the chair supporting same.

A problem often encountered by women when attending public places such as restaurants, meeting halls, and the like, is the disposition of their purses in a safe and convenient location. The instant invention provides a solution by utilizing a strip of flexible material folded so as to have an S-like cross-section with the two parallel opposed marginal edges seamed so as to form two pouches, having oppositely directed mouths. One pouch has its mouth displaced around the upper regions of a backrest of a chair. The other pouch, resides below its mouth and is positioned outwardly from the rearmost surface of the backrest of the chair. The purse, to be stored, is disposed within the upwardly turned pouch having the handle portion secured to the outermost surface of the common wall between the two pouches utilizing a securing strap therefor. One end of the securing strap is hingeably affixed to the common wall whilst the other end utilizes a pair of disengageable snap fasteners to removably entrap the purse handle between the innermost surface of the strap and the common wall. The pouch that is placed having its mouth disposed around the upper regions of the backrest of the chair is provided having an elongated flexible sheet-like portion, extending outwardly from the pouch-like portion surrounding the chair, such that the elongated sheet-like portion has a narrower width than the width of the two pouches. The elongated sheet-like portion has provisions enabling such elongated sheet-like portion to be selectively secured to the backrest portion of the chair or to portions of the remainder of the apparatus, such as the interior of the upwardly turned pouch or the uppermost edge of the inverted pouch. These fastening devices may be straps or complementary snap fasteners, or the like, comprising means to secure the device to the chair, thereby preventing the device to be accidentally or purposefully removed from the chair when so secured. In a preferred embodiment, the elongated sheet portion is provided with two snap fastener elements, the chair being provided with one complementary snap fastener element, secured to the back thereof, and a complementary snap fastener element being located within the confines of the upwardly directed pouch and still another complementary snap fastener element secured to the uppermost marginal edge of the downwardly turned pouch, on the exterior surface thereof. In use, the elongated sheet portion may be a width somewhat smaller than the width of the two pouch portions of the device. The elongated sheet portion has a length sufficient to allow a portion thereof to be draped on the uppermost seating surface of the chair, having another portion of the elongated sheet portion residing below the lowermost surface of the seat portion of the chair. The snap fastener elements, located adjacent to the free end of the elongated sheet portion, may then be selectively engaged with any one of the complementary snap fastener elements, so as to prevent the device from being removed from the chair, regardless of the location of the user, residing in a sitting position on a portion of the elongated sheet portion. If desired, the user need not fasten the snap fastener elements together, when sitting on the elongated sheet portion. Due to the simplicity of design and construction, costs are minimized and bulk is sufficiently reduced enabling the user to conveniently fold up the apparatus to be stored within the purse when not in use.

These objects, as well as other objects of the present invention, will become more readily apparent after reading the following description of the accompanying drawings.

DESCRIPTION OF THE PREFERRED EMBODIMENT

Figure 1:
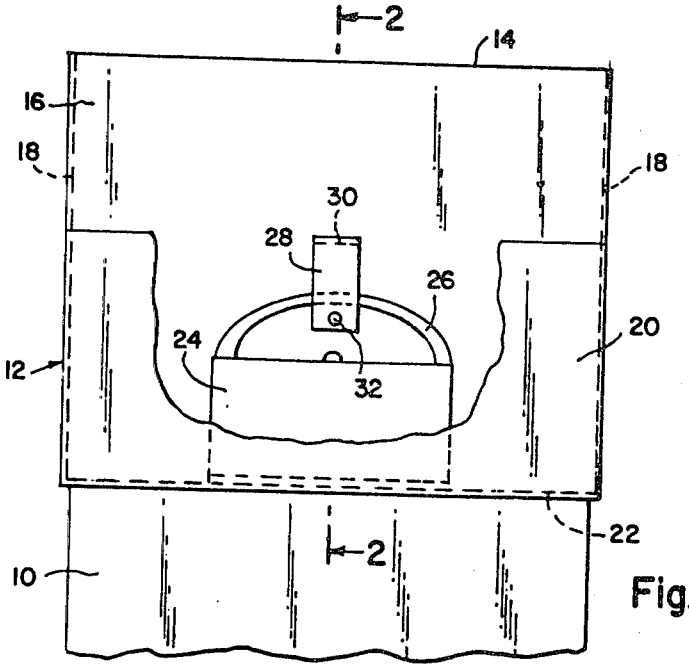
FIG. 1 is a rear elevation view of the instant invention, having a cutaway portion of a pouch illustrating a purse therewithin, installed upon a portion of a backrest of a chair.

The structure and method of fabrication of the present invention is applicable to a sheet of flexible material of substantially rectangular shape folded back on itself so as to create a substantially inverted U shaped cross-section. A second sheet of flexible material, whose width equals that of the first sheet, is fastened along three of its marginal edges to one of the legs of the inverted U shaped cross-section so as to provide a pouch whose open mouth resides above the pouch thus created. The U shaped cross-section is joined together at the side marginal edges. The U shaped cross-section is installed over the backrest of the chair such that the pouch is on the opposite side of the backrest opposing the surface from which the user of the chair gains back support. A flexible strap is sewn or otherwise fastened hingeably to the second sheet supporting wall at one end, utilizing a pair of snap fasteners to manually selectively engage the other end of the flexible strap to the common wall. A purse handle, attached to a purse stored within the pouch, may be grasped by the flexible strap and the common wall, which forms an encircling handle securing structure therefor. The second sheet or the first sheet or both may be fabricated from a transparent flexible material facilitating convenient viewing of the stored purse thereby.

The use of a first sheet and a second sheet may be eliminated, by utilizing only one sheet, folded so as to form the U shaped cross-section which may be installed on the backrest of a chair, and the other inverted U shaped cross-section, which is to act as a pouch for receiving therein a purse or other article for storage.

In an alternate embodiment, one portion of the single sheet construction, comprising both U shaped, cross-sections, or one of the pair of sheets, comprising both U shaped, cross-sections, may be elongated so as to extend outwardly from the portion of the sheet or sheets defining the inverted U shaped, cross-section, adapted to reside over the backrest of the chair. Such an elongated sheet may have a width narrower than the width of the inverted pouch-like, U shaped, cross-section which resides over the backrest of the chair. Such elongated sheet portion of the apparatus may be provided with one or more snap fastener elements, adapted to be removably engaged with complementary snap fastening elements that may be secured to an outermost, rearmost portion of the chair, or an interior surface of the purse receiving pouch, or an exterior surface of the inverted pouch-like, U shaped, cross-section. When the snap fastening elements are secured together, a portion of the elongated sheet-like portion may reside on the seat of such chair, having an adjacent portion of the extended sheet portion pass through the rear legs of the chair, up in the region of the backing near vertical surface of the chair. In this position, the entire apparatus is locked to the chair, eliminating pilferage, theft or even accidental dislodgement of the device from the chair. Alternatively, the extended sheet-like portion may be simply draped over the seat portion of the chair, so that a user, when sitting on the seat portion of the chair clamps the extended sheet portion between the user's torso and the seat portion of the chair, lockingly engaging the apparatus to the chair.

An additional flexible sheet, secured at opposed marginal edges, to an exterior surface of the purse receiving pouch, may be utilized to receive therein elongated articles of apparel, such as umbrellas, walking canes, or spectacles, as desired. Such additional sheet may be fabricated from a flexible plastic-like material, such as transparent polyvinylchloride and secured to the device, if desired, by conventional heat sealing means.

Now referring to the Figures, and more particularly to the embodiment illustrated in FIG. 1 showing the vertically disposed backrest portion 10 of a chair providing support for the instant invention 12. Edge 14 comprises a fold line separating rear sheet 16 and a front sheet, not shown, there-behind. The front sheet and the rear sheet are fastened together along dotted lines 18. Sheet 20 is affixed to sheet 16 along dotted lines 18 and dotted line 22. Purse 24 is stored between sheets 16 and 20 and is provided with handle 26. Flexible strip 28 is hingeably secured to sheet 16 along dotted line 30. Snap 32 is utilized to secure the other end of flexible strip 28 to sheet 16. Sheet 20, or sheet 16, or the front sheet, not shown, or combinations thereof, may be fabricated from a transparent flexible material.

Figure 2:
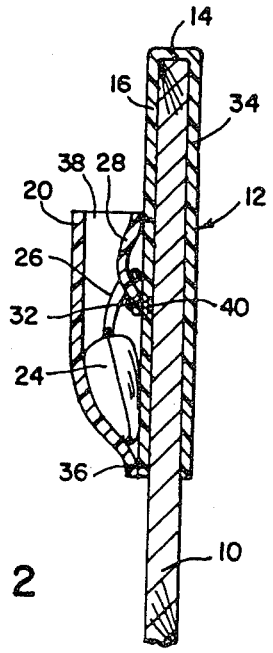
FIG. 2 is a side elevation cross-sectional view taken along line 2—2 viewed in the direction of arrows 2—2, as shown in FIG. 1.

FIG. 2 illustrates rear sheet 16 and front sheet 34 describing an inverted U installed over backrest 10. Sheet 20 is secured to sheet 16 at point 36, residing in dotted line 22 shown in FIG. 1. Mouth 38 permits the downward introduction of purse 24 within the pouch formed by sheets 16 and 20. Handle 26 is shown captured between flexible strap 28 and rear sheet 16. Snap 32 is shown engaged with a mating snap element 40 fixedly secured to sheet 16.

Figure 3:
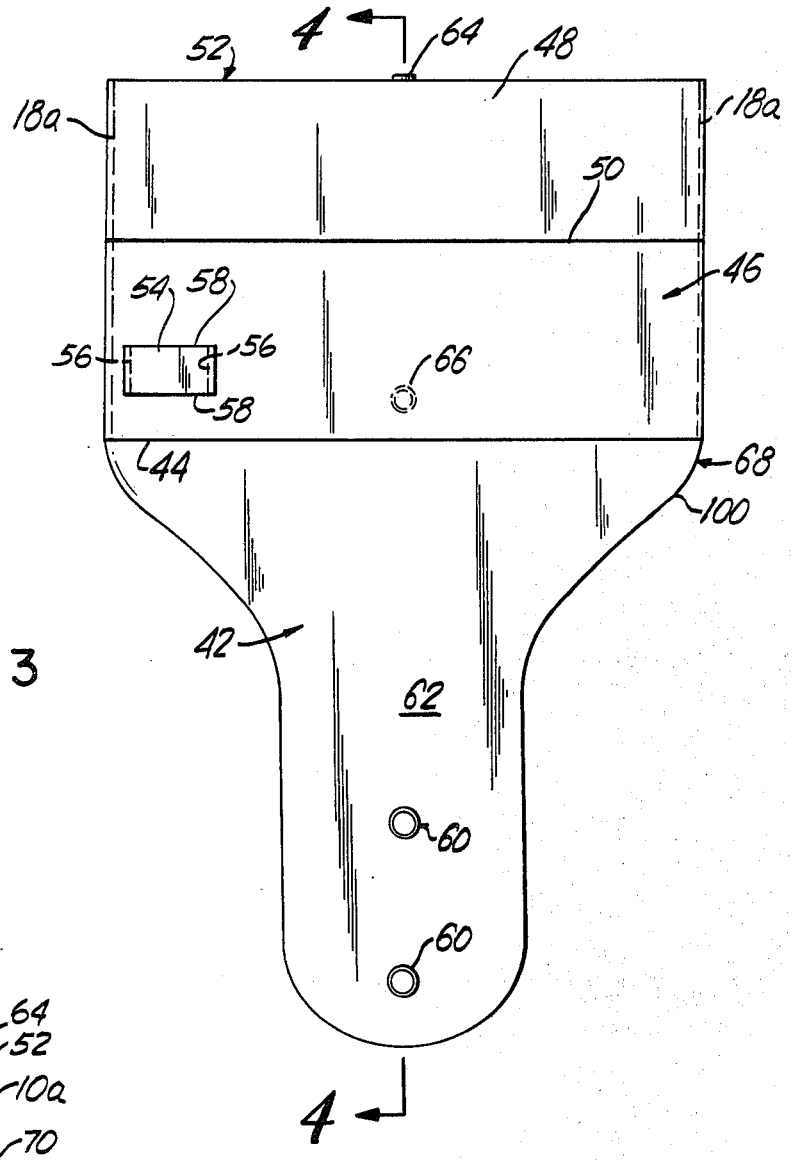
FIG. 3 is a front elevation view of another embodiment of the present invention.

FIG. 3 illustrates sheet 100, having elongated sheet portion 42 extending downwardly from line 44. Line 44 consists of a fold line in sheet 100, in which portion 46, of sheet 100, is disposed adjacent to and parallel to a portion of portion 48, of sheet 100. Marginal edge 50, of sheet 100, resides intermediate line 44 and line 52, of sheet 100. Line 52, represents a fold line, for which the uppermost portions of sheet 100, residing behind portion 48 thereof, are located. Such rearmost section, located behind portion 48, is contiguous with portion 42. Portions 46 and 48 are fastened together by any conventional means, along dotted lines 18*a*, as are portions 48 and the uppermost, rearmost section of portion 42. Additional flexible sheet 54, is secured to portion 46, along dotted lines 56, thereby providing unsecured edges 58 for the insertion of articles between the interior surface of additional sheet 54 and the exterior surface of portion 46. Snap fastener elements 60 are shown located on exterior surface 62 of portion 42. A complementary snap fastener element 64 is shown secured adjacent to line 52. Another complementary snap fastener element shown by dotted lines 66 is secured to the interior surface of portion 46, installed within the pouch-like portion formed by portions 46 and 48 of embodiment 68.

Figure 4:
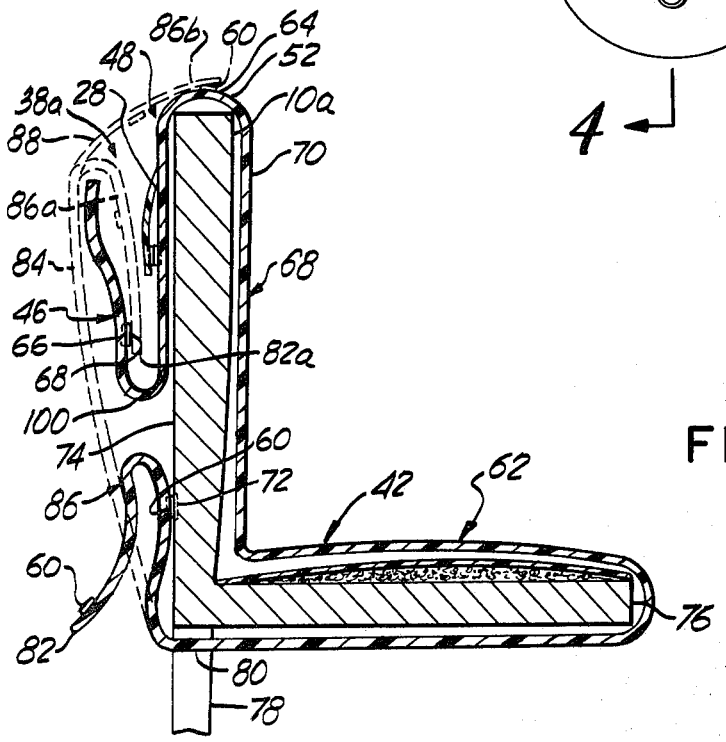
FIG. 4 is a side elevation, cross-sectional view, taken along lines 4—4, in the direction of arrows 4—4, as shown in FIG. 3, illustrating the alternate embodiment shown installed on a portion of a chair, also shown in side elevation, cross-sectional view.

FIG. 4 illustrates portion 46 being contiguous with portion 48. Elongated sheet-like portion 42, is shown contiguous with portion 70. One snap fastener element 60 is shown engaged to a snap fastener element 72, secured to the rearmost surface 74, of chair 10*a*. Seat portion 76 of chair 10*a* is shown having a portion of sheet-like portion 42 reside resting thereover. Leg portion 78, of chair 10*a* is shown, such that portion 80, of extended sheet-like portion 42, passes adjacent thereto, so as to have free end 82, of extended sheet-like portion 42, located in the rearmost portions of seat 10*a*. Alternatively, dotted lines 84 illustrate an alternate position for portion 86, of extended sheet-like portion 42 is shown having snap fastener elements 60 disengaged from complementary snap fastener element 72. In such alternate position, free end 82*a* may be engaged within pouch mouth 38*a*, such that snap fastener 60 may be engaged with complementary snap fastener 66, having portion 86, now shown by dotted lines 86*a*, reside within the pouch formed by portions 46 and portions 48 of sheet 100. Alternatively, dotted lines 88 illustrate another location for portion 86, designated as 86*b*. In the alternate location, wherein portion 82*b* is located adjacent fold line 52 such that snap fastener 60 is installed removably engaged with complementary snap fastener element 64. Thus, it can be seen that portion 86, of extended sheet portion 42, may be totally disengaged from chair 10*a*, as desired, or, in a first location, secured to snap fastener complementary element 72, or, if desired, to device 68, in either an interior location, by engagement with snap fastener element 66, or an exterior location, closing off mouth portion 38*a*, in engagement with complementary snap fastener element 64. It can be seen, that by closing off mouth 38*a*, a purse or other article for storage, is totally captured within the pouch formed by sheet portions 46 and 48, shown in FIG. 3, thereby providing additional security against theft or pilferage.

One of the advantages of the present invention is a purse storage device which may be conveniently employed on the backrest portion of a chair.

Another advantage of the present invention is a purse storing pouch whose storage capacity is bounded only by the width of a chair.

Still another advantage of the present invention is a purse storing slipcover which may be retained over the backrest of the chair by the application of binding forces applied by the back of the purse owner to the back supporting portion of the chair.

Yet another advantage of the present invention is a purse handle grasping strap which minimizes theft of the purse when stored within the pouch.

A further advantage of the present invention is a purse storing pouch whose outermost surface is provided with transparent material thereby minimizing the possibility of theft and accidental overlooking of the purse stored there behind.

A still further advantage of the present invention is an inexpensive purse storage device which may be stored within the purse when not in use.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

The embodiment of the invention in which an exclusive privilege or property is claimed are defined as follows:

1. A purse holder comprising a first pouch, said first pouch having first marginal edges disposed in a first rectangular shape, said first pouch having a first mouth extending along one side of said first rectangular shape, a second pouch, said second pouch having second marginal edges disposed in a second rectangular shape, said second pouch having a second mouth extending along one side of said second rectangular shape, said first pouch fixedly secured to said second pouch, said first mouth oppositely directed from said second mouth, purse handle fastening means for removably clamping a portion of a handle of a purse against an interior surface of said second pouch, wherein said interior surface defines a surface of a wall common to and separating said first pouch and said second pouch, whereby said purse may be entirely removably stored within said second pouch and having the entire said handle thereof removably enclosed within said second pouch, said first pouch including an elongated sheet portion thereof extending outwardly from said first rectangular shape, said elongated sheet portion being configured to have a length at least long enough to extend over and under the seat portion of a chair, whereby the free end of said elongated sheet portion extends outwardly from the rearmost underside portion of said seat portion of said chair, at least one snap fastener element being fixedly secured to said elongated sheet portion, at least one complementary snap fastening element, said at least one complementary snap fastening element fixedly secured to said second pouch adjacent said second mouth thereof, whereby engaging said at least one snap fastening element to said at least one complementary snap fastening element secures the purse holder to said chair.

2. The purse holder as claimed in claim 1 wherein said first pouch and said second pouch comprise a pair of flexible members, one of said pair of flexible members being folded into two parallel equi-sized panels about a fold line, said two parallel equi-sized panels being disposed in folded back relationship to each other, said first marginal edges of said first pouch being disposed in juxtaposed relationship, two of said first marginal edges being disposed normal to said fold line and in spaced apart relationship to each other, said two parallel equi-sized panels joined to each other along each of said two of said first marginal edges, the other of said pair of flexible members fixedly secured to said one of said two parallel equi-sized panels along three adjacent of said second marginal edges thereof.

3. The purse holder as claimed in claim 2 wherein two of said three adjacent of said second marginal edges being disposed in spaced apart parallel relationship co-terminus with said two of said first marginal edges and fixedly secured there-along.

4. The purse holder as claimed in claim 3 wherein the third of said three adjacent of said second marginal edges is disposed co-terminus with a free edge of said one of said two parallel equi-sized panels and fixedly secured there-along.

5. The purse holder as claimed in claim 2 wherein two of said three adjacent of said second marginal edges being disposed in spaced apart parallel relationship co-terminus with said two of said first marginal edges and fixedly secured therealong, the third of said three adjacent of said second marginal edges is disposed co-terminus with a free edge of said one of said two parallel equi-sized panels and fixedly secured there-along.

6. The purse holder as claimed in claim 2 wherein said purse handle fastening means comprises a flexible strap, one end of said flexible strap fixedly secured to said one of said two parallel equi-sized panels, a pair of removably engaging snap apart elements, one of said pair of removably engaging snap apart elements fixedly secured to said one of said two parallel equi-sized panels, the other of said pair of removably engaging snap apart elements fixedly secured to the other end of said flexible strap.

7. The apparatus as claimed in claim 1 wherein said first pouch and said second pouch is a continuous sheet of flexible material.

8. The apparatus as claimed in claim 1 wherein said another at least one complementary snap fastener is disposed fixedly secured within the interior of said second pouch, whereby a portion of said elongated sheet portion extends over said mouth when said at least one snap fastener is engaged with said at least one complementary snap fastener.

9. The apparatus as claimed in claim 1 wherein said another at least one complementary snap fastener is disposed secured to an exterior surface of said first pouch.

10. The apparatus as claimed in claim 1 wherein said extended sheet portion is disposed having a portion of the opposed marginal edges thereof separated a lesser distance than the distance defining said first mouth measured extending along said one side of said first rectangular shape.

* * * * *

UNITED STATES PATENT AND TRADEMARK OFFICE

CERTIFICATE OF CORRECTION

PATENT NO. : 4,302,046

DATED : Nov. 24, 1981

INVENTOR(S) : Esther Lazazzero

It is certified that error appears in the above-identified patent and that said Letters Patent is hereby corrected as shown below:

On the title page the illustrative drawing should appear as per the attached sheet.

Signed and Sealed this

*Twenty-ninth* Day of *March 1983*

[SEAL]

*Attest:*

GERALD J. MOSSINGHOFF

*Attesting Officer*

*Commissioner of Patents and Trademarks*

United States Patent [19]

Lazazzero

[11] 4,302,046

[45] Nov. 24, 1981

[54] PURSE HOLDER

[76] Inventor: Esther Lazazzero, 86 Greenlawn Ave., Clifton, N.J. 07013

[21] Appl. No.: 963,482

[22] Filed: Nov. 24, 1978

Related U.S. Application Data

[63] Continuation-in-part of Ser. No. 685,727, May 12, 1976, abandoned.

[51] Int. Cl.[3] ..... A47C 7/62

[52] U.S. Cl. ..... 297/191; 224/275; 297/219; 297/229

[58] Field of Search ..... 150/34; 224/275; 297/188, 191, 219, 229, 231

[56] References Cited

U.S. PATENT DOCUMENTS

| | | | |
|---|---|---|---|
| 1,279,915 | 9/1918 | Rogers | 150/34 |
| 2,223,532 | 12/1940 | Sallop | 297/191 X |
| 2,703,426 | 3/1955 | Barkl | 297/191 X |
| 3,014,759 | 12/1961 | Bing | 297/191 |
| 3,151,909 | 10/1964 | Gerdetz | 297/188 |
| 3,479,085 | 11/1969 | Weinstein | 297/219 |

FOREIGN PATENT DOCUMENTS

| | | | |
|---|---|---|---|
| 174850 | 2/1922 | United Kingdom | 297/119 |
| 1476493 | 6/1977 | United Kingdom | 297/191 |

*Primary Examiner*– William E. Lyddane
*Attorney, Agent, or Firm* –Robert D. Farkas

[57] ABSTRACT

This disclosure pertains to a slip cover device adapted to be positioned over the uppermost portions of a chair backrest. The open mouth portion of an inverted U shaped cross-section fabricated from a flexible material is applied downwardly surrounding the uppermost marginal edges of the backrest of the chair. The rearmost surface of the cover is provided with a pouch having an open mouth at the uppermost region thereof. A purse may be stored in the pouch, utilizing a flexible strip hingeably affixed at one end and removably affixed at the other end to the rearmost surface of the cover to capture the handle of the purse. One marginal edge of the inverted U shaped cross-section, that is applied downwardly surrounding the uppermost marginal edges of the backrest of the chair, is elongated, such that the elongated portion may be attached to selected areas of the chair itself or the pouch portions of the apparatus or the portion of the apparatus which resides on the top of the backrest of the chair.

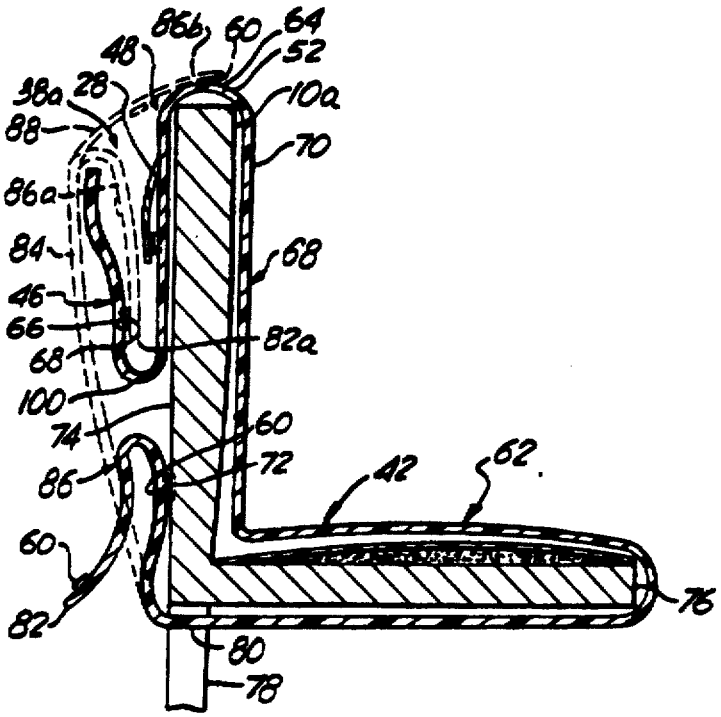

10 Claims, 4 Drawing Figures